US005346199A

United States Patent [19]

Martin et al.

[11] Patent Number: 5,346,199

[45] Date of Patent: Sep. 13, 1994

[54] ADJUSTABLE NUDGER ROLL NORMAL FORCE USING MULTIPLE SPRINGS

[75] Inventors: Michael J. Martin; Kathleen M. Martin, both of Hamlin; Russell J. Sokac, Rochester; Lloyd W. Durfey, Palmyra, all of N.Y.

[73] Assignee: Xerox Corporation, Stamford, Conn.

[21] Appl. No.: 143,953

[22] Filed: Nov. 1, 1993

[51] Int. Cl.[5] ..... B65H 7/08

[52] U.S. Cl. ..... 271/110; 271/117; 271/126; 271/155

[58] Field of Search ..... 271/110, 109, 117, 119, 271/126, 153, 155

[56] References Cited

U.S. PATENT DOCUMENTS

| | | | |
|---|---|---|---|
| 3,866,903 | 2/1975 | Eppe et al. | 271/119 |
| 3,981,497 | 9/1976 | Feinstein et al. | 271/110 |
| 4,157,825 | 6/1979 | Ellenberger et al. | 271/10 |
| 4,928,948 | 5/1990 | Evangelista et al. | 271/110 |
| 5,149,077 | 9/1992 | Martin et al. | 271/18.3 |

FOREIGN PATENT DOCUMENTS

| | | | |
|---|---|---|---|
| 0201736 | 9/1987 | Japan | 271/110 |
| 4303349 | 10/1992 | Japan | 271/110 |
| 4354736 | 12/1992 | Japan | 271/126 |

*Primary Examiner*—H. Grant Skaggs

[57] ABSTRACT

An adjustable nudger roll for use in a friction retard feeder includes multiple springs used in conjunction with the nudger roll in order to allow greater latitude for adjustment of the normal force of the nudger roll against a substrate stack and in order to reduce the incidence of misfeeds. This arrangement adjusts the normal force on substrates as the requirement of the feed force changes and thereby reduces misfeeds and multifeeds.

14 Claims, 3 Drawing Sheets

ADJUSTABLE NUDGER ROLL NORMAL FORCE USING MULTIPLE SPRINGS

This invention is directed generally to friction retard feeders, and more particularly, to an improved nudger system for use in such feeders that employs a multiple spring normal force arrangement to enable the adjustment of the nudger roll normal force.

Traditionally, nudger rolls are employed in friction retard feeders to move the top substrate(s) from a stack to a retard mechanism as a result of a net frictional force. The retard mechanism allows a single substrate at a time to pass through the mechanism. Some nudger rolls are constructed from an elastomeric material. These rolls have a failure mode of loss of a suitably high friction coefficient due to contamination, dirt build-up and wear. Other nudger rolls are in the form of a series of metal pin wheels which act to grab or stick the top sheet in the stack and move it into the friction retard mechanism. A studded roll of this type works well for most substrate types, and has a long roll life. However, the studded roll does not handle high density substrates very well due to an inability to penetrate the substrate surface. Also, the studded roll does not handle transparencies satisfactorily. Further, the studded roll may leave scratch marks on the surface of substrates fed at high feed rates.

When a rotating roll is used to feed the paper by the frictional force between them, the maximum available feed force is determined by the product of the normal force and the coefficient of friction between the roll and the substrate which could be paper, transparencies, etc. Because the coefficient of friction is uncertain in nature, the maximum available feed force is mainly controlled by the normal force. That is, as the required feed force increases, the normal force is also set to a larger value. In most machines that use nudger rolls as feed rolls, the normal force is set to a fixed optimum value to meet the particular design requirements. But there may still appear a failure such as misfeed as the design environment changes.

Where substrates or sheet of any kind are fed from a platform or tray that is moved up and down by an elevator, the misfeed recovery algorithm requires the elevator motor to incrementally increase the sheet stack height, thereby increasing the normal force on the top sheet of the stack. The maximum amount of height increase is limited by the geometry of the feeder entrance baffle. However, even with this forgiving design, the maximum incremental change in stack height is limited to a few millimeters. The limitation in stack height places a limit on the incremental normal force that can be applied to the sheet stack. That is, with a constant rate spring supplying the nudger normal force, the permissible amount of stack height travel limits the increase in normal force.

Attempts at overcoming these nudger roll deficiencies include U.S. Pat. No. 3,866,903 which discloses a sheet feeding apparatus that delivers a top sheet of a stack to advancing rolls by using a cylindrical sleeve comprised of an elastomeric material with a high coefficient of friction. The sleeve is rotated by a drive to move the top sheet towards the advancing rolls. A device for separating single textile workpieces from the top of a stack is shown in U.S. Pat. No. 4,157,825 that includes a holding member having holding pins and a rotatable member having a plurality of radially extending bristles. The holding member causes an engagement of the topmost workpiece with the pins. The rotatable member directs the topmost workpiece. A pair of nudger rolls are disclosed in U.S. Pat. No. 4,928,948 for urging a sheet toward feed rolls that are on the same centerline in the feed direction. A hybrid nudger roll is disclosed in U.S. Pat. No. 5,149,077 for use in a friction retard feeder that includes alternating elastomeric and studded rolls positioned on a support shaft. The outer surface of the elastomeric rolls extends beyond the tips of the studded rolls, but when the elastomeric rolls are deformed against a stack of sheets due to normal force, the tips of the studded rolls extends beyond the outer surface of the elastomeric rolls. Even with availability of the above-mentioned nudger rolls, the need still exists for a nudger roll useful in retard feeders for shingling a wide variety of substrates which can adjust the normal force as the requirements for the feed force changes.

Accordingly, in an aspect of this invention, a nudger roll system is disclosed that uses multiple spring action on the nudger roll of the system to allow greater latitude for adjustment of the normal force and thereby reduces the incidence of misfeeds. This arrangement adjusts the normal force on substrates as the requirement of the feed force changes and thereby reduces misfeeds and multifeeds.

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
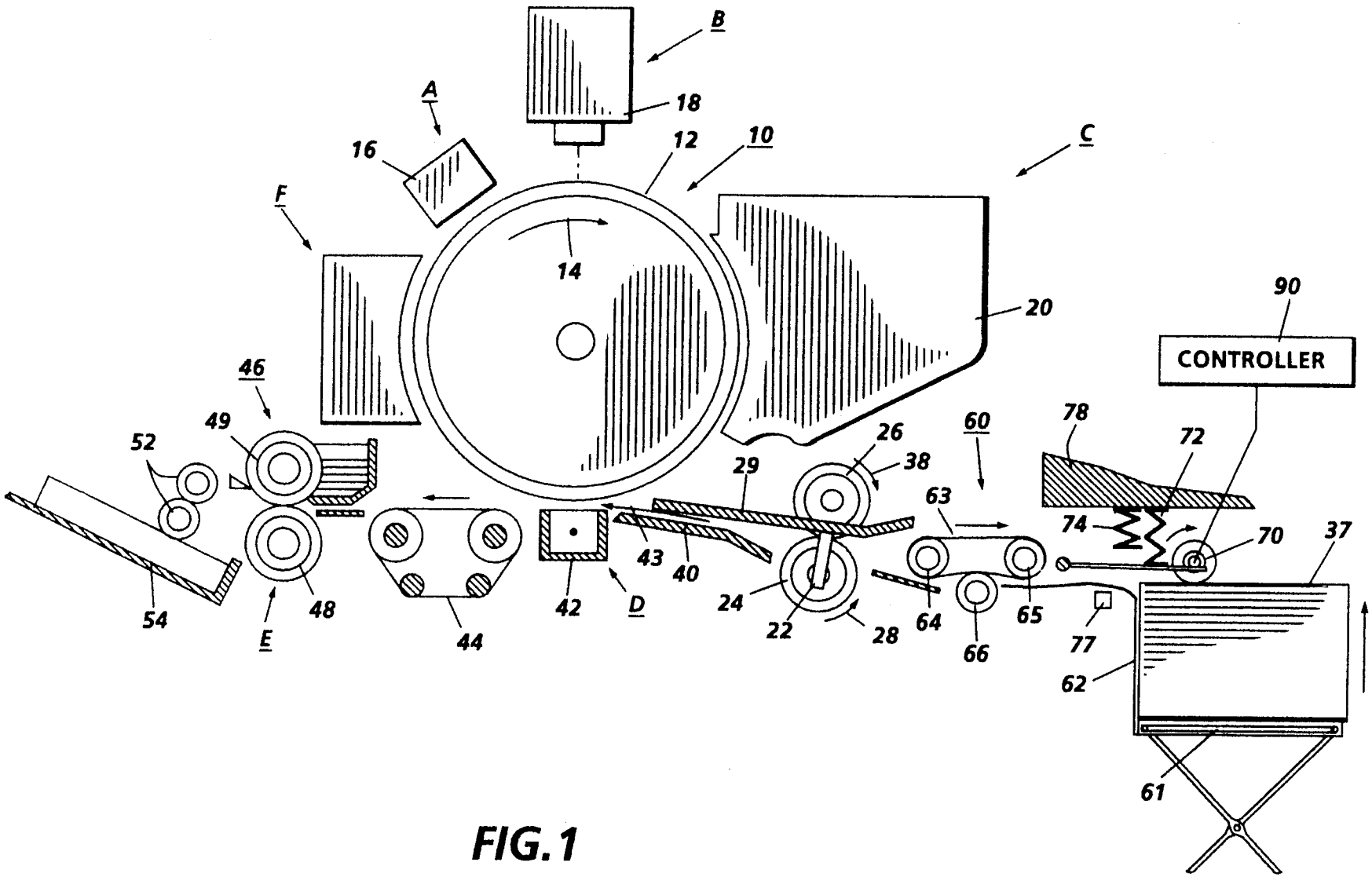
FIG. 1 is a schematic elevational view of an electrophotographic printing machine incorporating the features of one aspect of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in this application to the particular embodiment shown herein. For example, the apparatus of the present invention will be described hereinafter with reference to feeding successive substrates, such as, copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by retard sheet feeding apparatus 60 to transfer station D. Nudger roll 70 of sheet feeding apparatus 60 is controlled by controller 90 and advances one or more copy sheets to a retard nip formed at the unsupported section of belt 63 which is supported for rotation by drive roll 64 and idler roll 65 and retard roll 66. Retard roll 66 applies a retarding force to shear any multiple sheets from the sheet being fed and forwards it to registration roller 24 and idler roller 26. Registration roller 24 is driven by a motor (now shown) in the direction of arrow 28 and idler roller 26 rotates in the direction of arrow 38 since roller 24 is in contact therewith. In operation, feed device 60 operates to advance the uppermost sheet from stack 36 into registration rollers 24 and 26 and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed form photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the top feeder system in greater detail.

Figure 2:
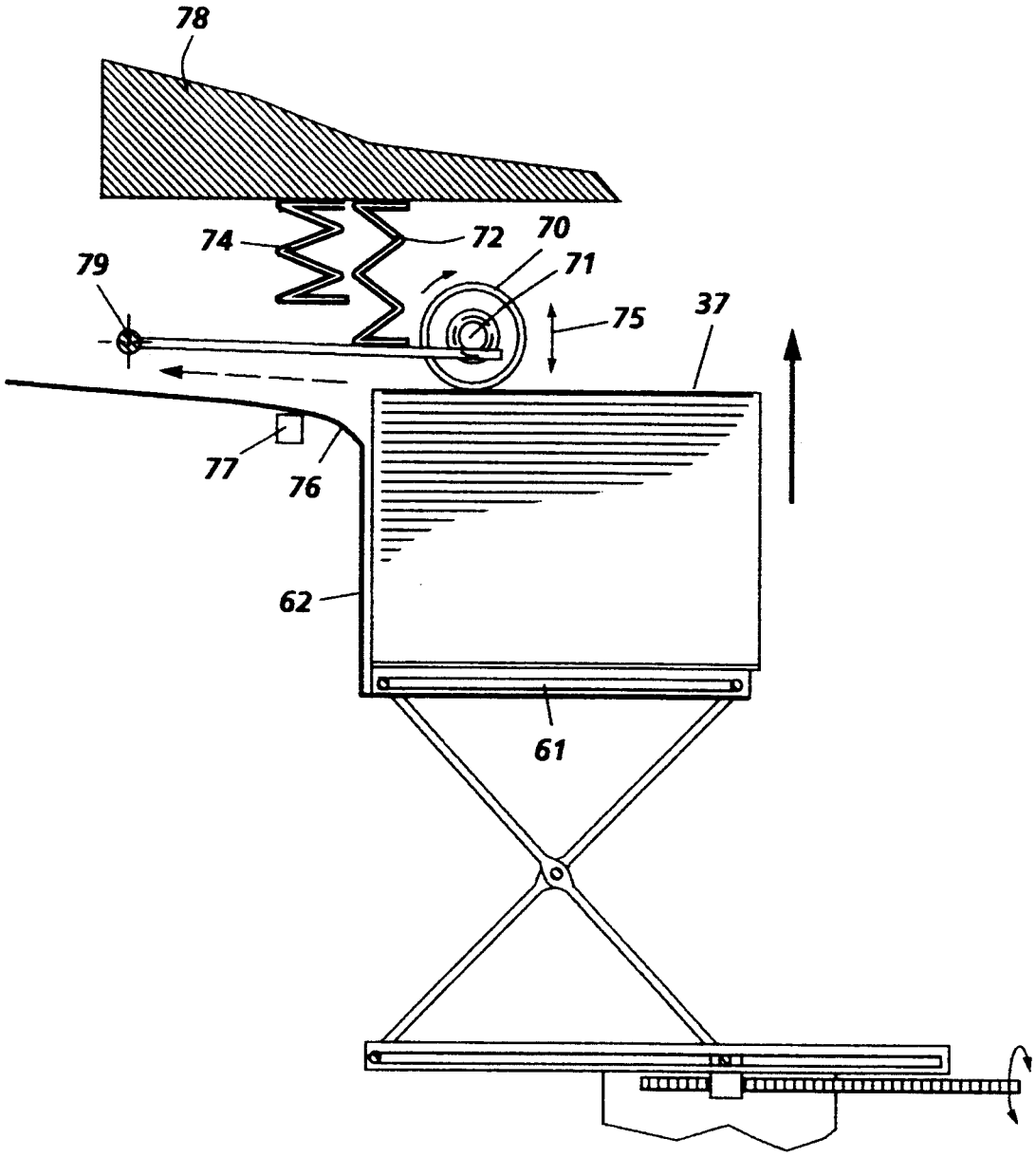
FIG. 2 is an enlarged partial side view of the adjustable nudger roll of the present invention shown in FIG. 1 with the multiple springs shown separately for clarity.

Referring now to FIGS. 1 and 2, the detailed structure and operation of the nudger roll will be described where retard feeder 60 includes an adjustable nudger roll 70 positioned above sheets 37 stacked on platform 61 that has a sheet retaining wall 62 attached thereto. The platform or sheet support 61 is movable incrementally to lift sheets 37 by a conventional motor (not shown). Nudger roll 70 is mounted on shaft 71 that is pivotably connected to shaft 79 for pivoting toward and away from the stack of sheets 37 in the directions of arrow 75. Sheets are fed from a platform or tray 61 as required and if a sheet does not reach sensor 77 in a preset time period, a signal is sent to controller 90 which in turn sends a signal to the motor connected to platform 61, such that, platform 61 is incrementally moved upwardly by the conventional motor since the misfeed recovery algorithm requires the elevator motor to incrementally increase the sheet stack height whenever a misfeed is detected, thereby increasing the normal force of the nudger roll on the top sheet of the stack. The maximum amount of height increase is limited by the configuration and location of the feeder entrance baffle 76. However, the maximum incremental change in stack height is limited to a few millimeters. This limitation in stack height places a limit on the incremental normal force that can be applied to the sheet stack. That is, with a constant rate spring 72 supplying the nudger normal force, the permissible amount of stack height travel limits the increase in normal force. A second spring 74 is provided to generate a larger change in the nudger roll normal force. The second spring 74 should be relatively stiff to allow a greater change in applied normal force over a small distance.

Figure 3:
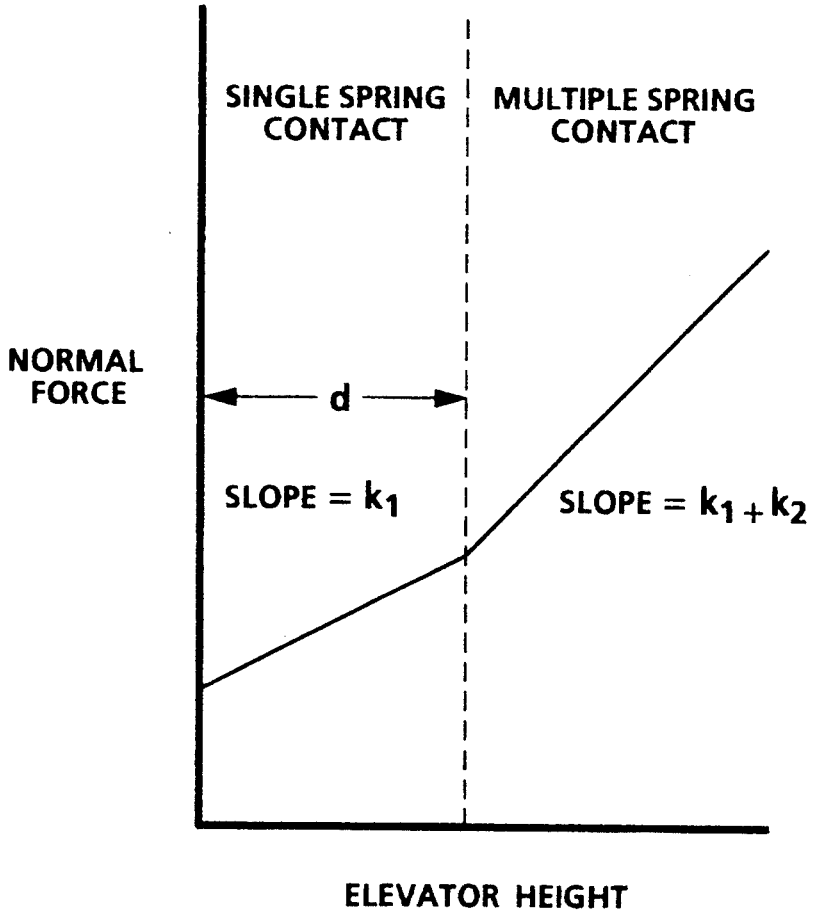
FIG. 3 is a graphic showing normal force of the nudger roll versus elevator height.
Figure 4:
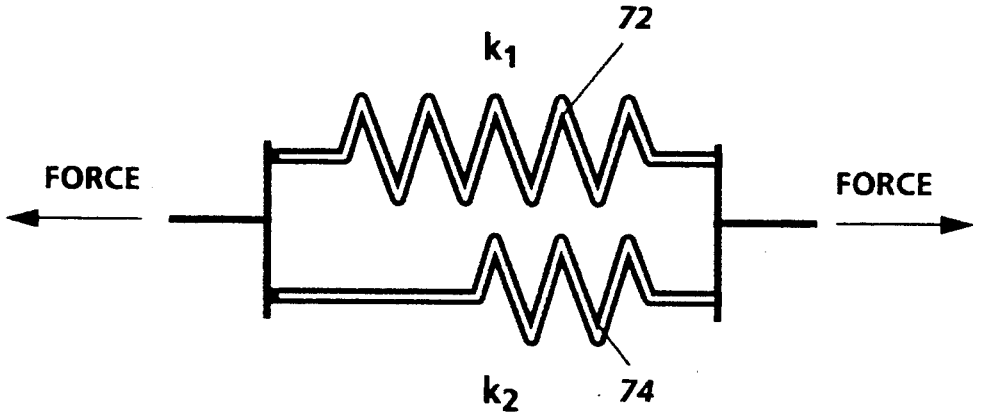
FIG. 4 is a schematic depiction of a spring model after a second spring has been compressed by x amount.

In operation, the standard nudger roll spring 72 is used during the regular feed cycle. In the event of a misfeed, the elevator height is increased, thereby compressing the nudger roll spring 72 and additional increment and increasing the applied normal force. After a set number of increments, nudger roll spring 72 is compressed a sufficient amount such that secondary spring 74 is compressed. The purpose of the second spring 74 is to allow a faster change rate in the applied normal force with respect to a change in the stack height. As seen in FIGS. 3 and 4, this purpose is accomplished where the graphic of FIG. 3 shows normal force versus elevator height and in FIG. 4 a spring model is shown after the second spring 74 is compressed by x amount. In FIG. 3, slope with contact of single spring 72 is equal to $k_1$ and multiple spring contact is equal to $k_1+k_2$ with d being the normal feed cycle normal force and initial increases in the normal force. FIG. 4 is reflected in the following formulas after the second spring has been compressed:

$$F=k_1x+k_2x+k_1d$$

$$F=(k_1+k_2)x+k_1d$$

$$k_{eq}=k_1+k_2$$

With this nudger roll system, there is a tendency to create a multifeed during a misfeed recovery, but this is not a problem with the active retard that is employed in this retard feed system. Advantages of this multiple spring adjustable nudger roll normal force apparatus include: an increase of normal force during a misfeed recovery; not affecting the normal feed cycle; and the system is a relatively inexpensive cost addition over the active nudger roll normal force feeder of prior systems such as shown in copending, commonly assigned U.S. application Ser. No. 07/983,933, to Michael J. Martin et al which is entitled APPARATUS AND METHOD FOR SHEET FEEDING AND SEPARATING USING RETARD ROLL RELIEF/ENHANCEMENT and incorporated herein by reference.

In conclusion, an adjustable nudger roll normal force apparatus is disclosed which uses multiple springs on a nudger roll of an active friction retard feeder to enable greater latitude for the adjustment of the normal force and thereby reduce incidents of misfeeds. The apparatus uses non-linear spring action to accomplish the greater normal force.

It is, therefore, evident that there has been provided in accordance with the present invention a nudger roll for use in a friction retard feeder which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An adjustable nudger roll feeding system for use in a friction retard feeder for feeding substrates from a stack to a retard mechanism, comprising:

a controller;

an elevator mechanism adapted to support the substrate stack and incrementally index the substrate stack upwardly as required by said controller;

a sensor connected to said controller and positioned downstream of the substrate stack in the direction of substrate feeding, said sensor being adapted to sense the time it takes a substrate fed from the substrate stack to reach said sensor, whereby if a substrate does not reach said sensor in a predetermined time a signal is sent to said controller which actuates said elevator to incrementally index the stack of substrates upwardly;

a nudger roll pivotably mounted to feed substrates individually from the stack of substrates past said sensor;

a first spring mounted to apply a normal force to said pivotably mounted nudger roll in order to press said nudger roll against the substrate stack for feeding substrates from the stack by said nudger roll toward said sensor; and a second spring mounted to be engaged by said nudger roll only after said first spring has been compressed a predetermined amount by upward movement of the substrate stack by said elevator mechanism after a misfeed has been sensed by said sensor, said second spring member being adapted to generate an optimum change in the nudger roll normal force over a minimal incremental index of said elevator mechanism.

2. The nudger roll system of claim 1, wherein said first spring is a constant rate compression spring.

3. The nudger roll system of claim 2, wherein said first and second springs use non-linear spring action to accomplish greater normal force.

4. A friction retard feeder apparatus for feeding substrates from a stack to a retard mechanism, comprising:

an elevator mechanism adapted to support a substrate stack and incrementally index the substrate stack upwardly as required;

a pivotable shaft;

an adjustable nudger roll mounted on said pivotable shaft;

a first spring mounted to apply a normal force to said nudger roll in order to press said nudger roll against the substrate stack so as to provide sufficient normal force of nudger roll against the substrate stack to feed substrates therefrom; and a second spring mounted to be compressed by pivotal movement of said nudger roll and apply an additional normal force on the substrate stack only after said first spring has been compressed a predetermined amount by upward movement of the substrate stack by said elevator mechanism.

5. The friction retard feeder apparatus of claim 4, wherein said first spring is a constant rate compression spring.

6. The friction retard feeder apparatus of claim 5, wherein the spring action of said first and second springs is non-linear.

7. A reproduction system adapted to make copies of page image information by transferring the page image information to substrates fed from a substrate feeder apparatus, comprising:

an elevator mechanism adapted to support a substrate stack and incrementally index the substrate stack upwardly as required;

a pivotable shaft;

an adjustable nudger roll mounted on said pivotable shaft;

a first spring mounted to apply a normal force to said nudger roll in order to press said nudger roll against the substrate stack in order to provide sufficient normal force of nudger roll against the substrate stack to feed substrates therefrom; and a second spring mounted to be compressed by pivotal movement of said nudger roll and apply an additional normal force on the substrate stack only after said first spring has been compressed a predetermined amount by upward movement of the substrate stack by said elevator mechanism.

8. The reproduction system of claim 7, wherein said first spring is a constant rate compression spring.

9. The reproduction system of claim 8, wherein the spring action of said first and second springs is non-linear.

10. The reproduction system of claim 8, wherein nudger roll is cantileverally mounted.

11. The reproduction system of claim 10, wherein said first spring is mounted to be compressed by pivotal movement of said pivotable shaft.

12. The reproduction system of claim 10, wherein said second spring is mounted to be compressed by pivotal movement of said pivotable shaft.

13. The reproduction system of claim 7, wherein said first spring is positioned downstream of said nudger roll.

14. The reproduction system of claim 13, wherein said second spring is positioned downstream of said first spring.

* * * * *